US005941396A

United States Patent [19]

Le Vert

[11] Patent Number: 5,941,396

[45] Date of Patent: Aug. 24, 1999

[54] WIRE DISPENSER STAND

[76] Inventor: Richard Francis Le Vert, 998 Jasmine Avenue, Victoria, British Columbia, Canada, V8Z 2P2

[21] Appl. No.: 08/898,290

[22] Filed: Jul. 22, 1997

Related U.S. Application Data

[63] Continuation-in-part of application No. 08/755,201, Nov. 25, 1996, which is a continuation of application No. 08/298,159, Aug. 30, 1994.

[30] Foreign Application Priority Data

Sep. 2, 1993 [CA] Canada ..... 2105463

[51] Int. Cl.[6] ..... A47F 7/00

[52] U.S. Cl. ..... 211/13.1

[58] Field of Search ..... 211/13.1, 85.5, 211/44

[56] References Cited

U.S. PATENT DOCUMENTS

| | | | |
|---|---|---|---|
| D. 76,906 | 11/1928 | Victor | 211/44 |
| 169,904 | 11/1875 | Hilliker . | |
| 430,141 | 6/1890 | Myers . | |
| 1,417,234 | 5/1922 | Duke . | |
| 1,429,587 | 9/1922 | Harris . | |
| 2,398,413 | 4/1946 | De Laurentis et al. . | |
| 2,911,265 | 11/1959 | Hannah . | |
| 2,962,167 | 11/1960 | Storey et al. | 211/85.5 |
| 3,084,803 | 4/1963 | Bayers | 211/85.5 |
| 3,430,773 | 3/1969 | Hancock | 211/85.5 |

OTHER PUBLICATIONS

Advertisements in Sep. 1997 edition of *The Electrical Advertiser* for SpoolMaster and Wyrecart.

1997 Ideal Industries, Inc. brochure for Smartcart transportable wire dispenser.

*Primary Examiner*—Alvin Chin-Shue
*Assistant Examiner*—Sarah Purol
*Attorney, Agent, or Firm*—Jeffrey T. Daines; Barrigar & Moss

[57] ABSTRACT

The stand comprises a base and an upright fixed to and integral with the base and is preferably injection molded as a single integral unit. Such stands are intended to be used in pairs. The upright has a collared hole or other support means for supporting an end of a spool or reel support axle so that a wire dispenser may be rotatably mounted on such axle supported by a pair of stands. The stands are securably and releasably engageable with one another as by a snap fit so that two such stands may be temporarily secured together to form a compact structure for storage or transport. This interfitting combination can also be used as a workstand whose upper work surface is the inverted base of one of the stands.

Preferably two such stands are also inter-connectable at their tops so that the inverted base serves as an elevated work surface.

The upright may also be fitted with beam-supporting cavities for supporting the ends of a beam so that the combined structure may form a stable framework for a table or work surface.

26 Claims, 14 Drawing Sheets

WIRE DISPENSER STAND

RELATED APPLICATION

This application is a continuation-in-part of U.S. patent application Ser. No. 08/755,201 filed on Nov. 25, 1996, which is a continuation of U.S. patent application Ser. No. 08/298,159, filed on Aug. 30, 1994.

FIELD OF THE INVENTION

The present invention relates to wire dispenser stands, and more particularly, to wire dispenser stands that matingly and compactly engage one another for storage and transport.

BACKGROUND OF THE INVENTION

Electricians at construction sites need to dispense electrical wire from wire reels. Many electricians do not use currently available dispensing apparatus, but simply pull wire from the reels while allowing the reels to roll freely on the floor, or else they improvise a dispenser apparatus using a length of pipe or conduit as an axle supported by two ladders that act as stands on which to rotatably mount the wire reel. At a new construction site, an electrician may mount an axle using nails driven into studs. Each of these improvised dispensing methods has disadvantages. Wire reels left to roll around the floor can be dangerous, inconvenient, and lead to inefficiency due to clutter in the workplace. Ladders are large and may be needed for other purposes. Locations available for suitably suspending or supporting an axle may not be convenient or available.

One reason for which many electricians tend not to use currently available wire dispensing apparatus is that the space that an electrician typically has available in his service vehicle for transporting specialized tools is limited. Known wire-dispensing apparatus is typically large, heavy, single-purpose, and often unwieldy to move to and from the construction site.

Therefore, it would be desirable to provide stands for supporting a wire dispenser, such as a wire reel, that are convenient to use and compactly storable for transport as well as convertible to other uses when not needed for dispensing wire, and that can be inexpensively manufactured.

SUMMARY OF THE INVENTION

In accordance with an aspect of the present invention, there is provided a wire dispenser stand (for use as one of a pair of identical such stands) comprising a base and an upright fixed to and preferably integral with the base. The upright has axle support means (in the simplest case, a hole, preferably formed with a collar for giving support to the cable reel support shaft or axle) for supporting an end of a spool or reel support axle, whereby a wire dispenser may be rotatably mounted on such axle supported by the pair of such stands, one at each end of the axle. Suitably configured and located mating engagement means are provided for interlocking or snug or snap fitting a first such stand with a second such stand, whereby two such stands may be temporarily secured together to form a compact structure for storage or transport, while being readily releasably disengaged from one another to support an axle. The base and the upright are preferably of generally rectangular parallelepiped shape, having vertical, axially horizontal and lateral dimensions that are selected to provide convenient support for one or more wire dispensers, and preferably provided with suitable strengthening ribs as well as the engagement elements to be described further below. The material thickness and density of the material used to form the upright and the base should be selected to permit adequate strength for the intended purpose, while being thin enough to afford light weight for ease of carrying.

In a preferred embodiment of the present invention, the engagement means comprises a configured engagement end (preferably of generally elongated rectangular shape) of the top of the upright and at least one mating recess in the base structure located near the bottom of the upright. While many different structural arrangements are possible to form such recess or recesses, in the preferred embodiment, at least one and preferably at least two securing ribs extending generally axially horizontally in a direction generally parallel to the axle for the wire dispenser and perpendicular to the opposed vertical surface of the upright is fixed to the base. One end of the securing rib is generally axially horizontally spaced from the lower end of the opposed face of the upright by approximately the thickness of the mating upper engagement end of the upright, thereby forming a recess between the securing rib and the upright that can matingly receive the inverted upper end of an identical such dispenser stand. When the two identical stands are interfitted, the inverted top end of one fits into the mating recess next to the bottom of the upright on the other, and vice versa, thereby creating a double interfit. Preferably more than one point of mating engagement is provided to afford greater stability of the interfitting structure. Note that the securing ribs also act as strengthening ribs.

In this interfitted configuration, the two uprights of the two stands are positioned immediately adjacent one another and more or less in contact. Note that this interfitting combination of two identical stands creates a temporary work bench or workstand whose upper horizontal work surface is the inverted base of one of the stands. For added stability of the interfitting arrangement, the fit of the top end of one stand into the recess of the other is preferably a snap fit or at least a snug fit; other suitable stabilizing structure could be employed to substitute for or to supplement this arrangement. A snap fit can be readily obtained by providing a mating flanged portion or similar such structure at the upper end of the upright of a first such stand that can be captured in a snap fit in the recess between the securing rib and the upright of a second such stand.

Preferably at least two and optionally more than two such securing ribs can be provided over the lateral extent of the base, so that the upper end of the upright may be matingly engaged at several points across the lateral extent of the base. If desired, the spacing between the securing rib end and the upright can be varied, and the width of the engagement end of the top of the upright can be correspondingly varied, so that such varying interfit spacing affords some degree of lateral interference between matingly engaged uprights, thereby inhibiting lateral displacement of one stand relative to an interfitting such stand when the two are matingly engaged with one another.

In the foregoing preferred embodiment of the invention, the stand is advantageously injection molded as a single integral unit from semi-rigid material so that the upright and the securing rib or ribs are integral with the base. Preferably, for stability and ease of location of strengthening ribs, the upright is located generally centrally of the axially horizontally extending dimension of the base.

The mating engagement elements of the preferred embodiment are provided with mating configured surfaces. The upright of each such stand is provided with a flanged generally horizontal upper end. Each such stand is also provided with a mating recess for the upper end, the recess formed between the upright and an adjacent end of the securing rib opposed to the upright, the lower surface of the recess being formed by the intervening horizontal portion of the base. The opposed end of the securing rib that forms one side of the recess preferably has a flat, narrow, vertical surface extending upward from the base, followed by a lip or crest or other suitable protrusion, and ending at the top in a ramp portion angled slightly to the vertical in a direction away from the opposed upright. The lip is horizontally spaced from the opposed upright by a distance slightly less than the thickness of the flanged engagement end of the top of the upright and is spaced from the base by a distance just greater than the thickness in a vertical sense of the flange on the top end of the upright. This configuration provides a snap fit of the upper flanged end of the upright of one stand into the mating recess of an identical such stand. The lip, engaged in a snap fit by the flange of the mating upright, resists vertical displacement (and consequent disengagement) of the upper end of the upright of one interfitting such stand relative to the other such stand. Note that the outwardly flared upper ramp portion of the rib facilitates insertion of the flanged engagement end of the upright into the mating recess for ease of engagement of the upper flanged end of one stand with the mating recess of another identical stand.

In the preferred embodiment of the present invention, the vertical surface of the upright facing the opposed rib is planar, so that when two stands are interfitted, they have contacting planar surfaces. The reverse vertical surface of the upright is preferably provided with a plurality of raised strengthening ribs.

In the preferred embodiment of the invention, the top flanged end of each upright is preferably provided with interfitting means for matingly engaging the top flanged end of the upright of another such stand, so that two such stands can be interconnected at their top surfaces, the upper of the two being inverted to accomplish this interconnection, and as a consequence presenting what would normally be the underside of its base as an elevated horizontal work surface. In a simple such interfitting arrangement, the upper surface of each upright may be provided with two or more spaced apertures into which dowels or pins or other suitable fasteners may be inserted so as to provide a connection between the facing top surfaces of the two identical uprights, the "top" surface of the uppermost such stand of course no longer being on top, because of the inversion and reversed vertical orientation of the uppermost stand.

In the preferred embodiment of the invention, at least one beam-supporting cavity is provided in the upright for supporting the end of one or more (preferably at least two) beams such as 2×4 lengths of lumber. When the beam ends are suitably placed in the opposed cavities of two mating uprights, the combined structure is both stronger and more stable than that provided by the mating stands alone. The cavity may be formed as a combination of strengthening ribs and/or horizontal supports in the uprights, optionally combined with at least one supporting surface in the base. At least one hole passing through the upright into the receiving cavity is preferably provided for securing the end of a piece of lumber (say) in the receiving cavity with a screw or nail. Lumber-gripping ribs or protrusions may penetrate into the cavity to provide a tight fit with the lumber retained in the cavity. Several cavities may be provided at spaced locations to permit varying the location of the end of the beam or beams used in a combined structure.

When the top end of one inverted such stand matingly engages the top flanged end of the upright of another such stand, so that two such stands are interconnected at their top surfaces, with the front faces of both stands oriented in the same direction, and then paired with a second set of similarly coupled stands oriented so that the front faces of each pair of stands are directly opposite one another, and at least two pieces of lumber or other suitable beams are affixed at each end into the corresponding receiving cavities on each pair of stands and each affixed with a nail or screw, the combined structure may form the framework for a table or work surface.

The present invention seeks to overcome drawbacks of wire dispensing stands known in the prior art by providing a light-weight, compactly storable and transportable wire dispenser stand that is adaptable to other purposes, notably the workstand purposes described above.

BRIEF DESCRIPTION OF THE DRAWINGS

In the drawings, which illustrate embodiments of the invention.

DETAILED DESCRIPTION OF THE INVENTION

Figure 1:
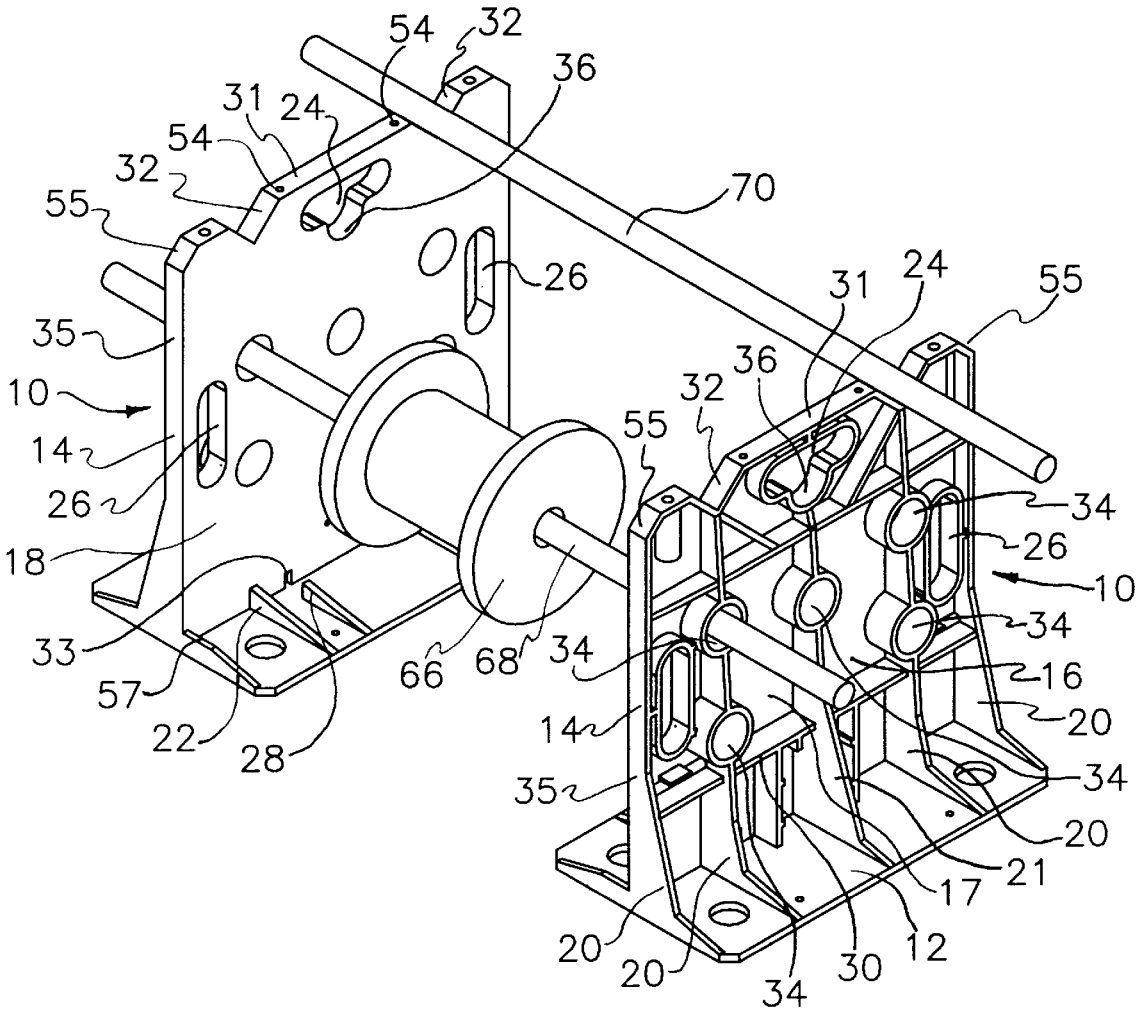
FIG. 1 is an isometric view of two identical wire dispenser stands each embodying the present invention and an axle supporting a wire reel and a pipe in position to be cut.

FIG. 1 shows two identical wire dispenser stands, each of which is an embodiment of the present invention, and each of which is generally indicated by numeral 10, supporting an axle or shaft 68 on which is rotatably mounted a wire reel or spool 66, thereby forming a wire dispenser. Also illustrated in FIG. 1 is the use of two stands 10 to provide a support for cutting a pipe or conduit 70.

Each stand 10 is preferably formed as a single integral unit by injection molding of structural foam polyethylene or other suitable plastics material into a mold (not shown).

Figure 9:
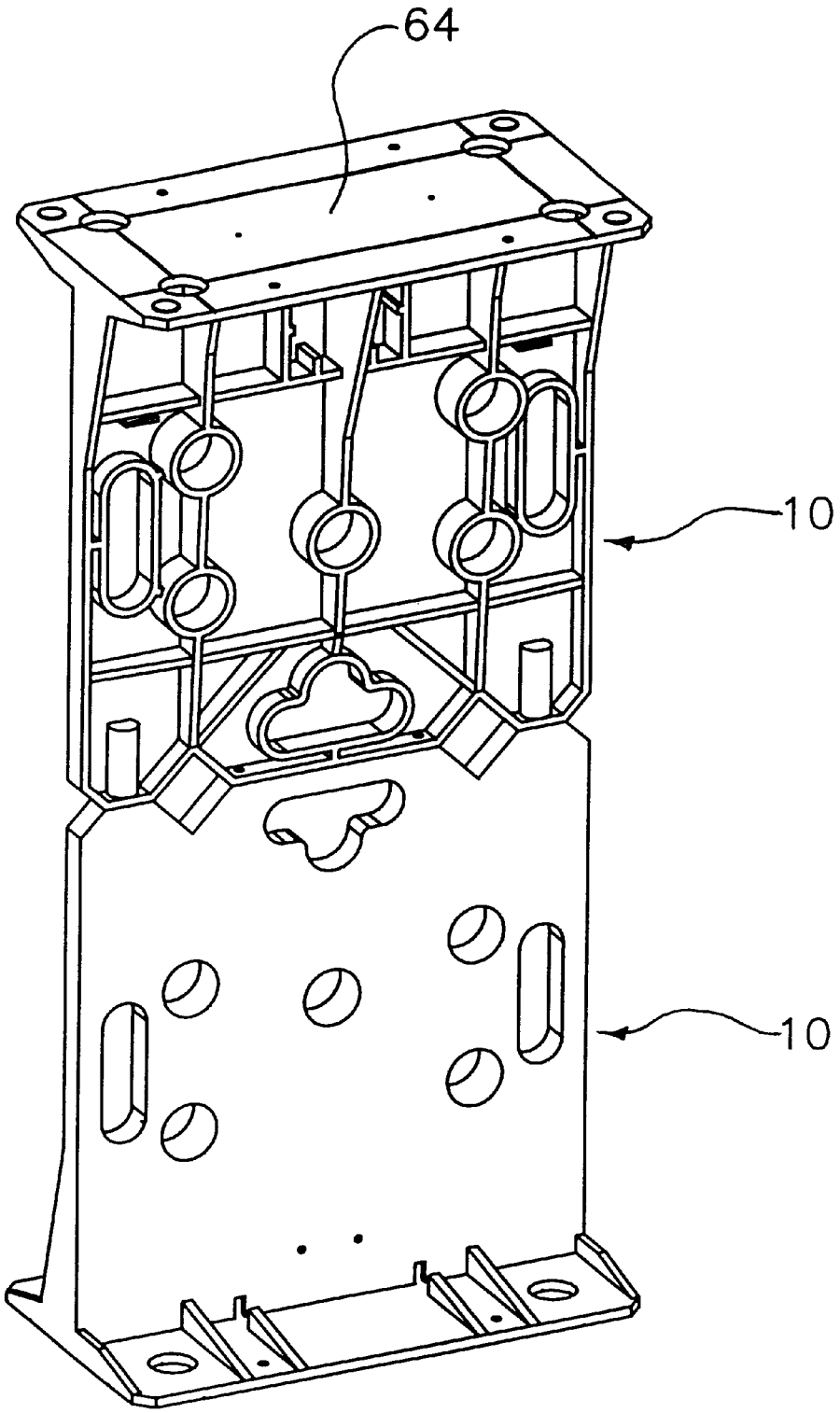
FIG. 9 is an isometric view of the two stands of FIG. 8 coupled together to form a single high table.
Figure 10:
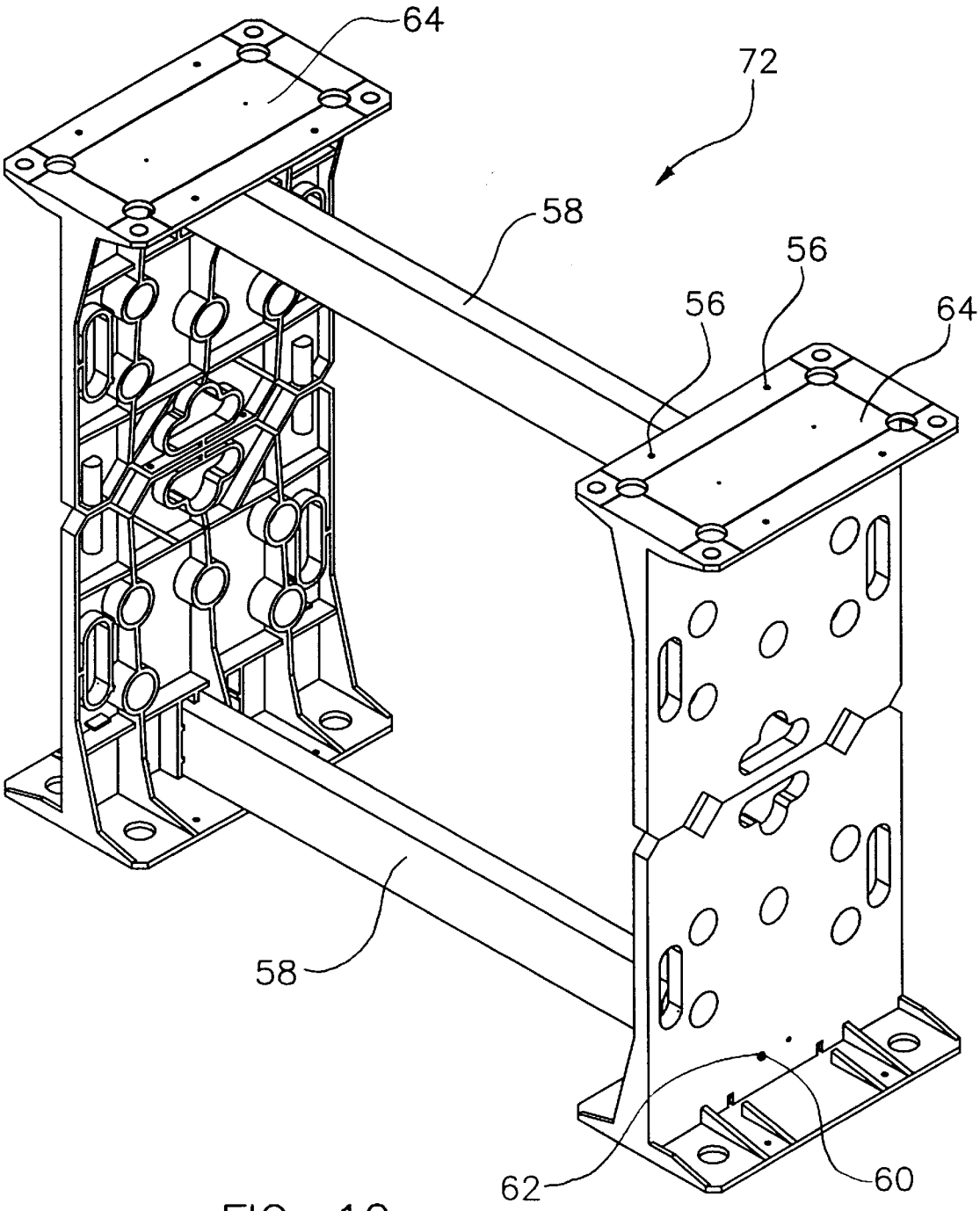
FIG. 10 is an isometric view of two of the high tables of FIG. 9 linked together by two 2×4s to form a support for a table top.
Figure 11:
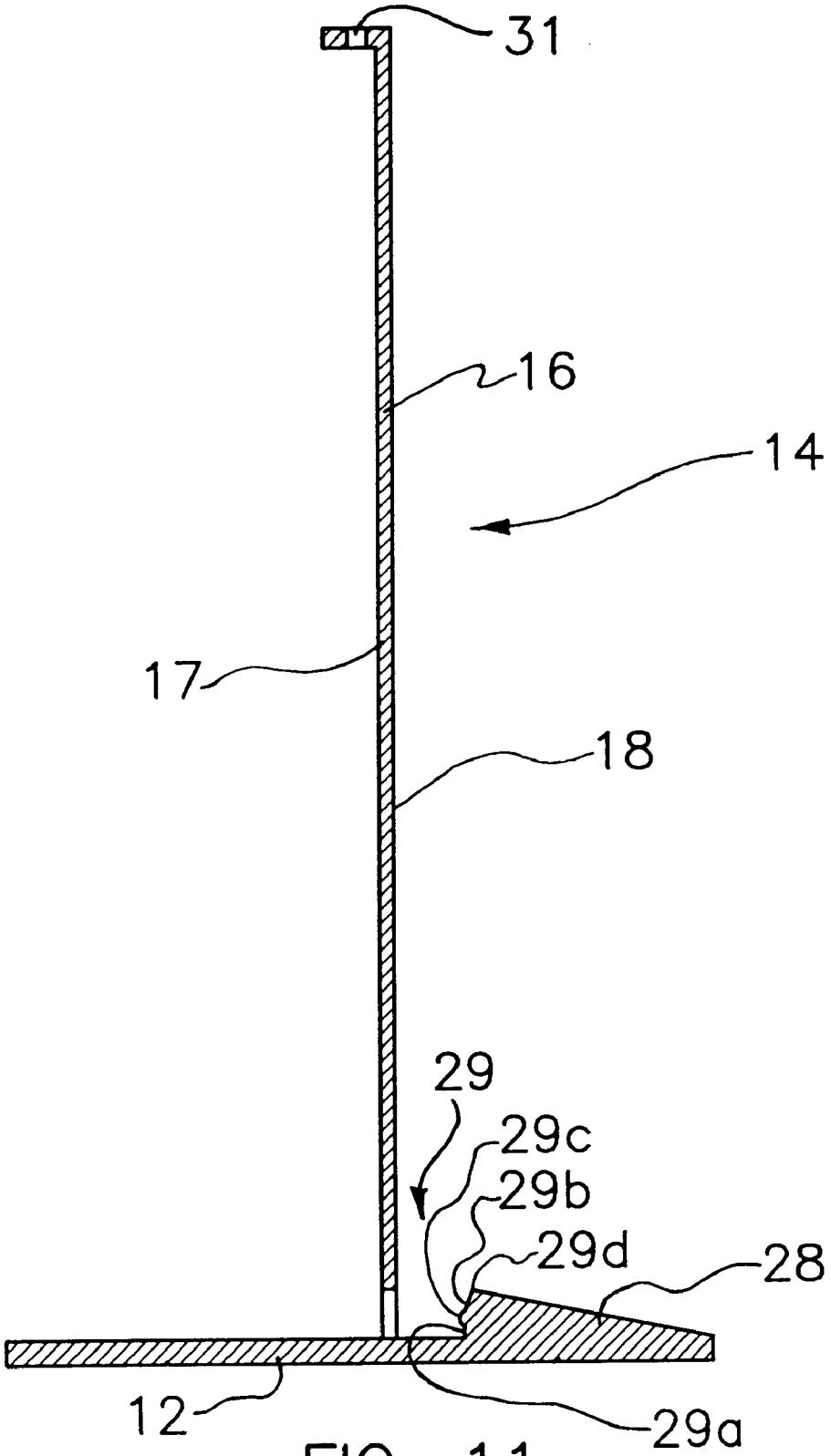
FIG. 11 is a schematic side section view of one of the stands of FIG. 1 taken along the line 11—11 in FIG. 3.

As illustrated in FIG. 1, each stand 10 is generally comprised of a generally rectangular base 12, the base 12 having a smooth bottom surface 64 visible in FIGS. 6–10, and a generally rectangular upright 14 extending perpendicularly from the base 12 to a top end 31 and having generally vertical sides 35. Each upper corner of the upright 14 is cut-off at approximately 45 degrees to the vertical sides 35 so as to provide the upright 14 with angled sides 55 connecting each vertical side 35 to top end 31. The stand 10 has a generally flat back face 18. The upright 14 may be solid, but a box-like structure with strengthening members as described below is preferred to reduce the weight of the stand 10. The upright 14 is therefore generally comprised of a panel 16 having a front surface 17, sides 35/55, and top end 31. The relationship of the panel 16, the front surface 17, the back face 18, and the top end 31 is shown in FIG. 11.

The upright 14 is penetrated by five circular axle collared holes 34 (five holes being exemplary for convenience of use; varying numbers, positions, and diameters of holes can be selected as required), a top handle grip opening 24 having an axle indent 36, and two side handle grip openings 26. Using one or more of the axle holes 34 and, if necessary, the axle indent 36, multiple axles may be used to support multiple wire reels simultaneously. A large wire reel may be supported using an axle supported by the axle indents 36. In an exemplary such stand in operative configuration, the top end 31 is approximately 17" above the bottom surface 64, so that a wire reel as large as 30" in diameter may be supported using the axle indents 36. Almost all wire reels commonly in use by electricians are 30" or less in diameter.

The front surface 17 of the panel 16 is connected to the base 12 by a large center support rib 21 and four large side support ribs 20 to increase the strength of the stand 10. The upright 14 is also provided with strengthening ribs 30 protruding from the front surface 17 of panel 16. The strengthening ribs 30 surround the holes 34 and the grip openings 24/26 forming collars for the grip openings 24/26, as well as criss-crossing the front surface 17 of panel 16 and connecting with the center support 21 and the side supports 20.

The top end 31 of each stand 10 is provided with two V-shaped notches 32 and two top screw holes 54. The notches 32 may be used for retaining pipe, conduit, metal studs, metal track, or threaded rods as illustrated in FIG. 1 for cutting or other purposes.

The material thicknesses of the upright 14 and the base 12 are selected to provide adequate strength without adding unnecessary weight. Note that the ribs 30 and supports 20/21 provide the stand 10 with strength while reducing the weight of the stand 10 and amount of material needed to form the stand 10. In an exemplary such stand, the thickness of the upright 14, excluding the supports 20/21, varies from approximately an inch at the top end 31 to approximately one-and-one-half inches where ribs 30 meet the supports 20/21. The ribs may extend in such exemplary stand about an inch from the adjoining base or upright surface.

Figure 2:
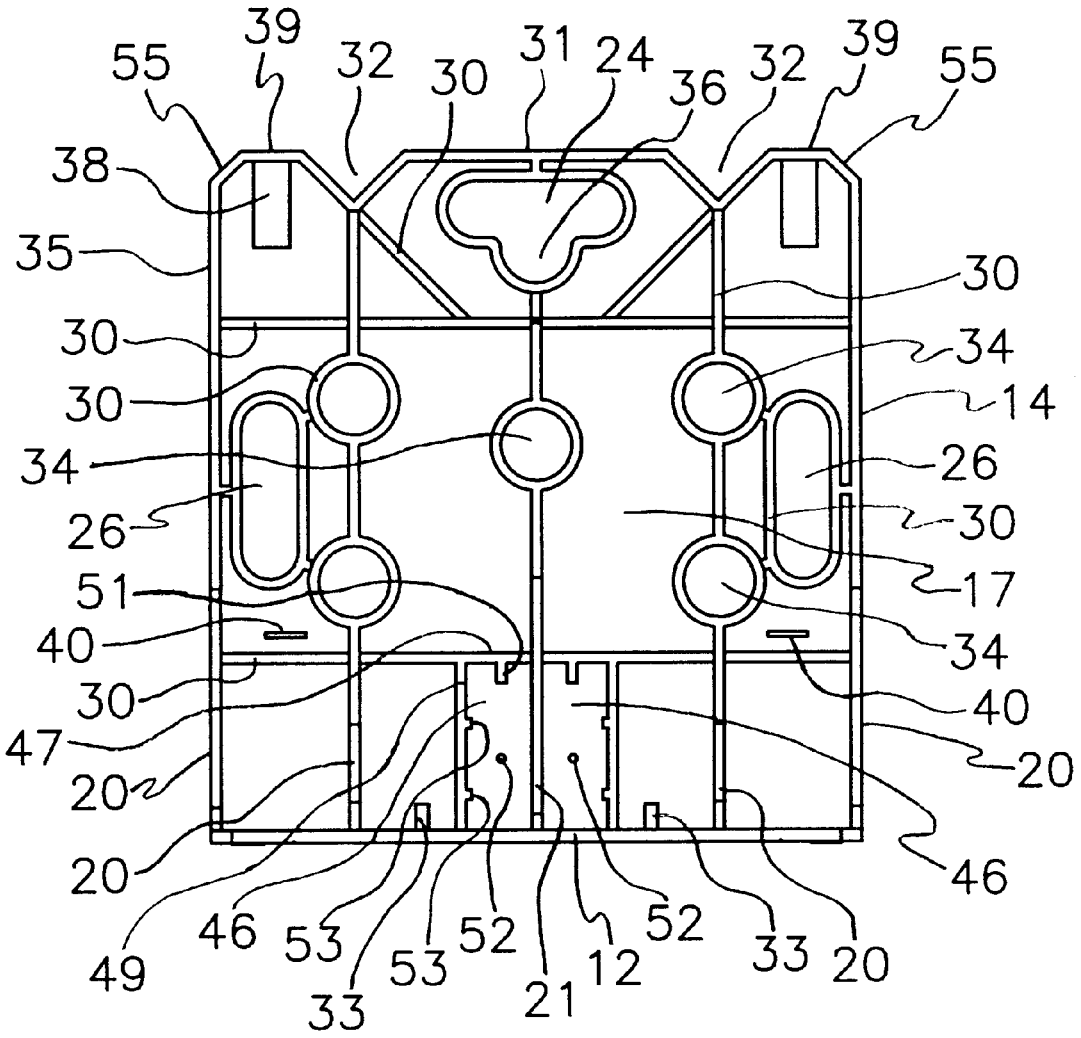
FIG. 2 is front elevation view of one of the stands of FIG. 1.
Figure 4:
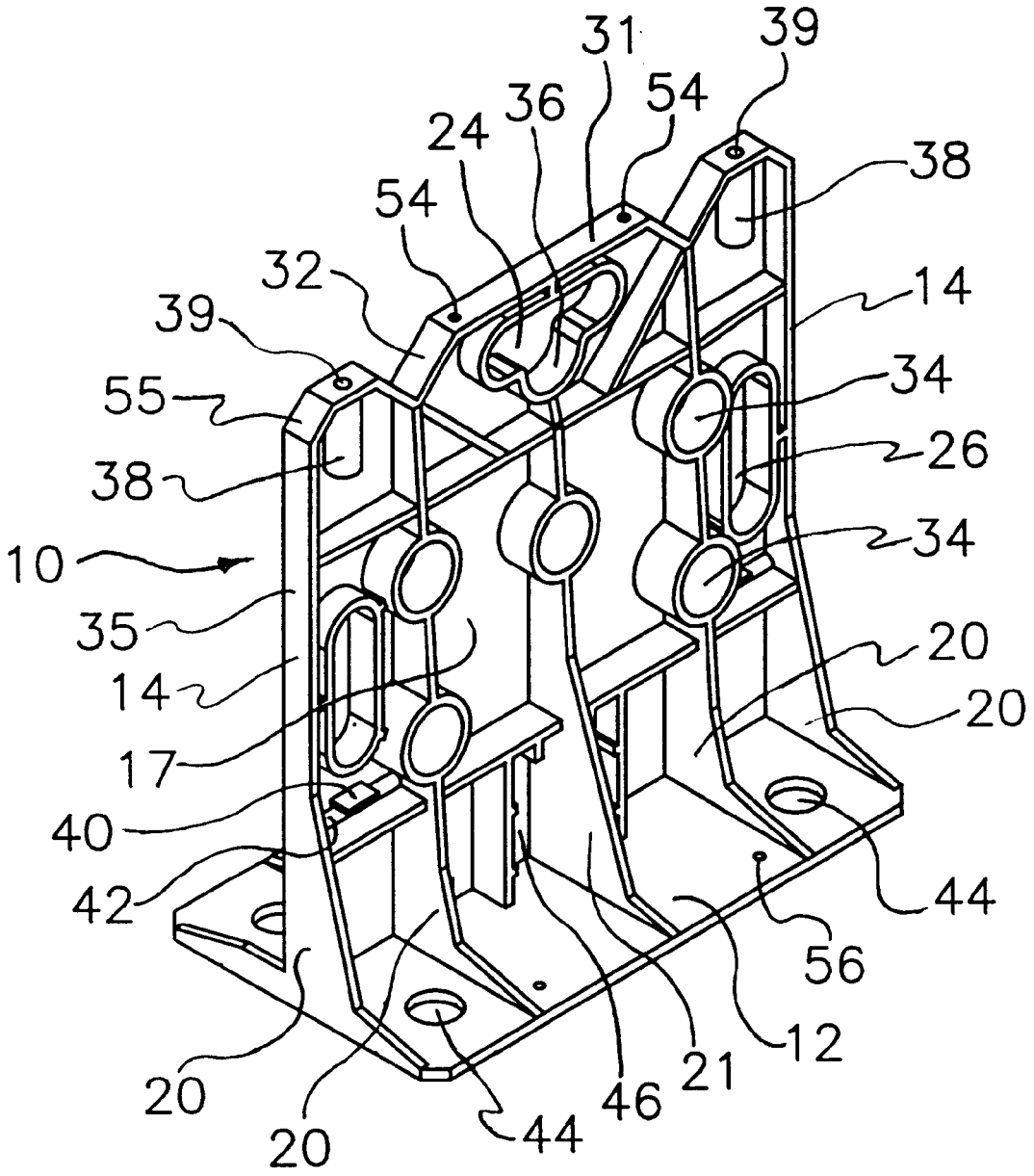
FIG. 4 is an isometric view generally toward the front of one of the stands of FIG. 1.

As better illustrated in FIGS. 2 and 4, the upright 14 of each stand 10 is provided with two receiving cavities 46. Each receiving cavity 46 is bounded by the large center support 21, a horizontal rib section 47 and a vertical rib section 49, the panel 16, and the base 12. Each horizontal rib section 47 is provided with a generally rectangular tab 51 extending downward. Each vertical section 49 is provided with two generally rectangular tabs 53 extending toward the center support 21. The distal surface of the tab 51 is at a slight angle relative to the surface of the horizontal rib section 47 such is that the tab 51 is wedge-shaped, with its thickest end integral with the front surface 17. Similarly, the distal surface of each tab 53 is at a slight angle relative to the surface of the vertical section 49 such that each tab 53 is wedge-shaped, with the thickest end of each tab 53 integral with the front surface 17. In an exemplary structure, the midpoint of the end of each tab 51 is spaced from the surface of the base 12 by 3⅝", and the midpoint of the end of each tab 53 is spaced from center support 21 by 1⅝", with the thickness of each of the tabs 51 and 53 varying by 1/16". A cavity screw hole 52 is provided in the portion of the front face 16 which forms a portion of the boundary of the receiving cavity 46.

Figure 3:
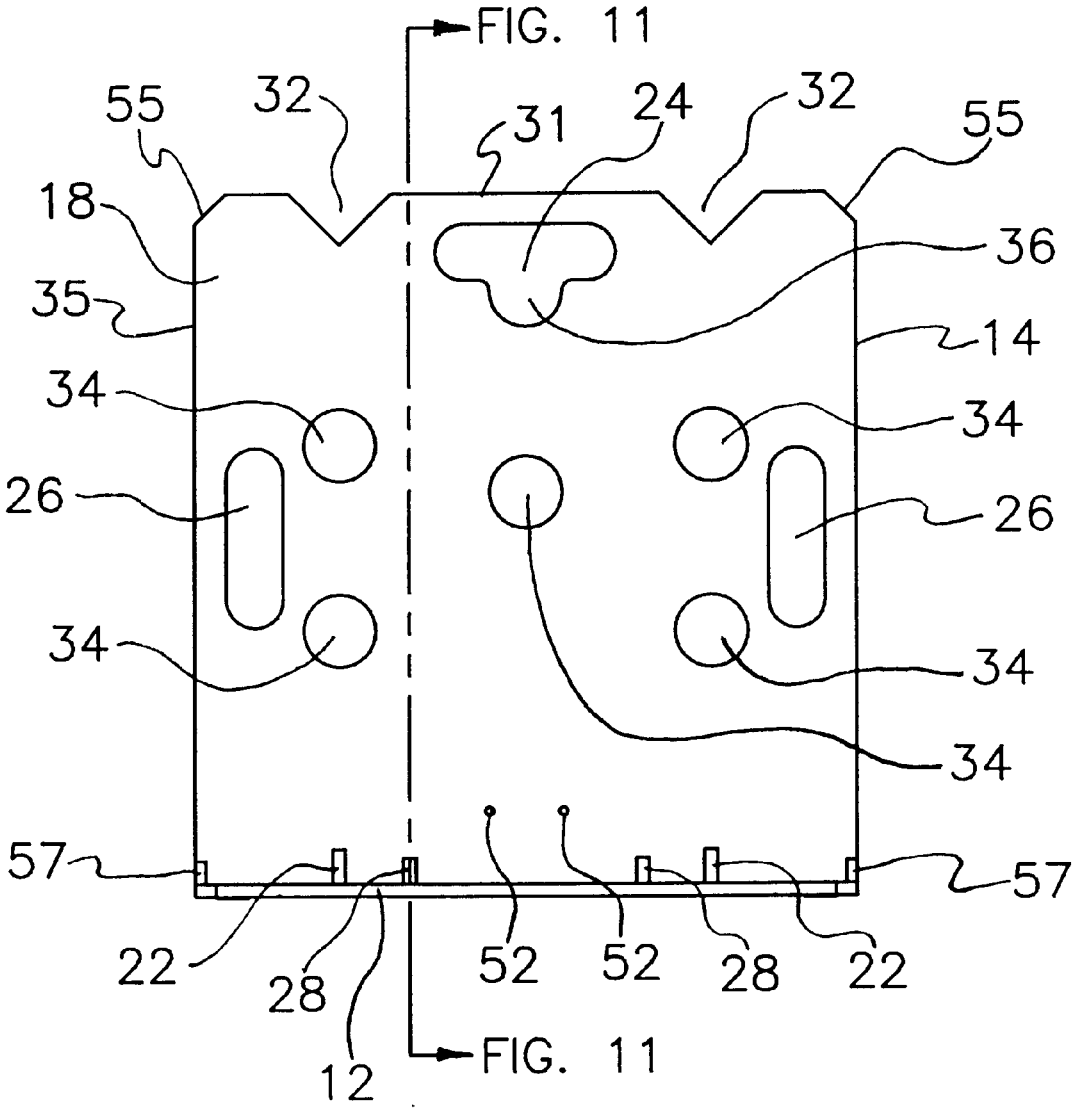
FIG. 3 is back elevation view of one of the stands of FIG. 1.
Figure 5:
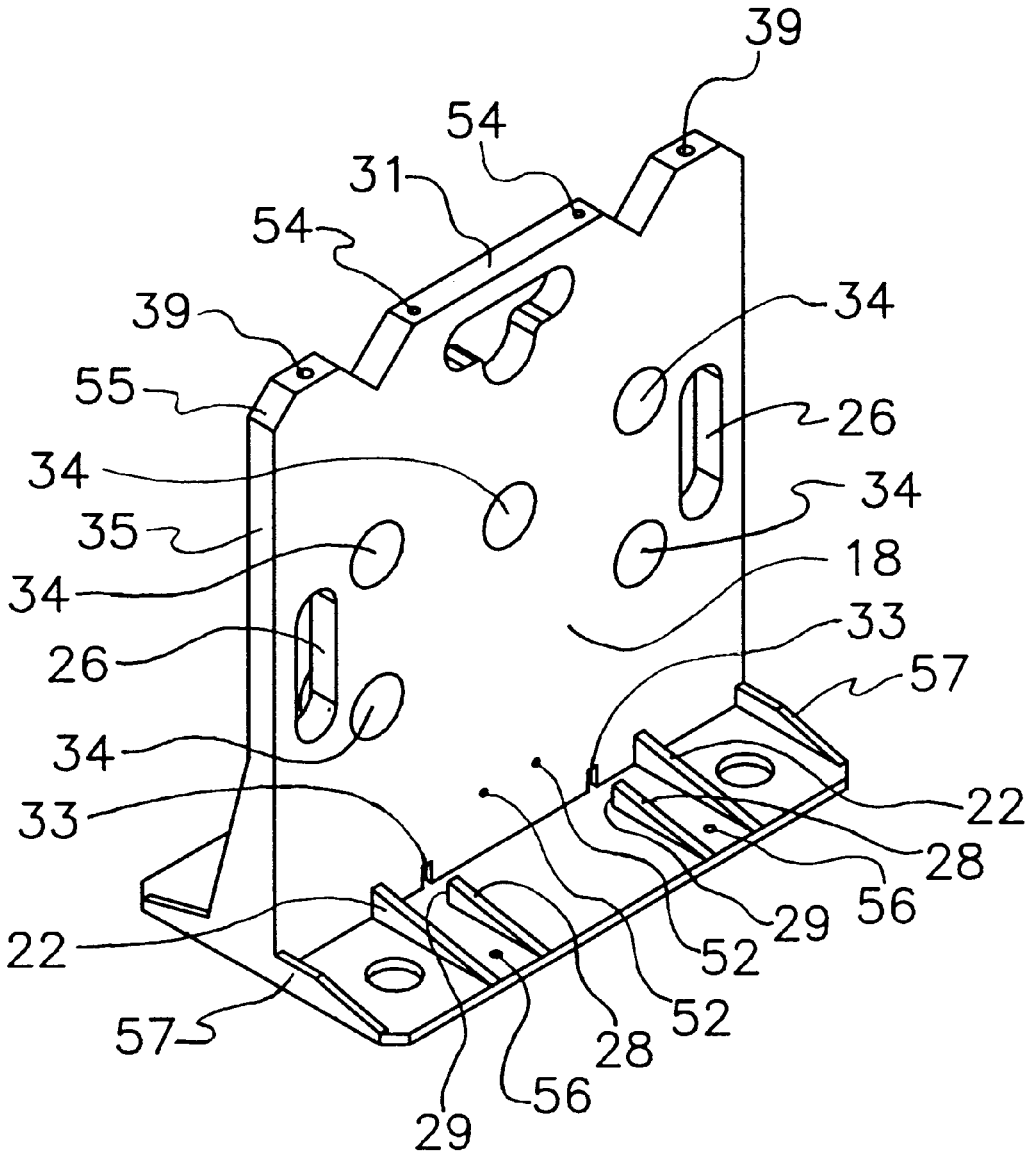
FIG. 5 is an isometric view generally toward the back of one of the stands of FIG. 1.

As illustrated in FIGS. 3 and 5, the back face 18 is connected by two small supports 22 to the base 12. Each small support 22 is located directly below a corresponding one of the V-shaped notches 32 so that two stands 10 may be coupled in the manner described below and illustrated in FIGS. 6 and 7 without the small supports 22 interfering with the sliding together of the stands 10. Two securing ribs 28 protrude from the base 12 adjacent to the back face 18. The back face 18 is also connected to the base 12 by two side ribs 57, one at each end of the base 12. Each side rib 57 is directly below the lowest portion of a corresponding angled side 55 so as to encourage alignment of two stands 10 as they are slid together as described below.

FIG. 11 illustrates in detail the relationship of a securing rib 28 and the back face 18. The securing rib 28 has a rib face, generally indicated by reference numeral 29, facing the back face 18, which rib face 29 is comprised of a planar lower portion **29*a* parallel to the back face 18, a horizontally extended lip 29*c*, a horizontally extended planar ramp portion 29*b*, and an end 29*d*. Molding opening 33 as shown in FIG. 5 is used during the molding process to accurately form the rib face 29. Lower portion 29*a* is spaced from the back face 18 by a distance slightly greater than the thickness of the upright 14 at the top end 31. The spacing between the rib face 29 and the back face 18 decreases at the lip 29*c* to slightly less than the thickness of the upright 14 at the top end 31. The exact spacing is determined by adjusting the mold (not shown) used to form the stands 10 so that the top end 31 on one stand 10 can be pushed in or pulled out past the lip 29*c* of a second stand 10 with approximately a 10 pound push or pull. Over the ramp portion 29*b*, from the lip 29*c* to the end 29*d*, the spacing in an exemplary structure between the rib face 29 and the back face 18 increases to reach 15/16" at the end 29*d*. The lower portion 29*a* in such exemplary structure is ¼" high, which is also the thickness of the top end 31. The spacing between the back face 18 and the rib face 29 and the slight compressibility of the material forming the stand 10 allows the top end 31 of one stand 10 to be pushed between the ramp 29*b* and the back face 18 until the top end 31 moves past the lip 29*c* and snaps into its retained position between the lower portion 29*a* and the back face 18 of a second identical stand 10 in the manner described below. The lip 29*c* retains the top end 31 in contact with the base 12, until force is applied to pull the top end 31 back out past the lip 29*c***.

Note that the specific means to obtain a snap fit can be selected at the discretion of the designer. For example, a channel-type recess provided with a retaining lip could be formed in the base to receive the flanged top of the upright in a mating engagement. Indeed, a snap fit is not necessary, although it is convenient. A snug fit or an interlocking fit (the latter rendered disengageable by lateral sliding of one stand relative to the other) could be substituted. The object is to provide a good mating fit when two identical stands are coupled together, and to provide stability of the interfitting combination so that the combination functions satisfactorily as a workstand and can be conveniently transported and stored.

Figure 6:
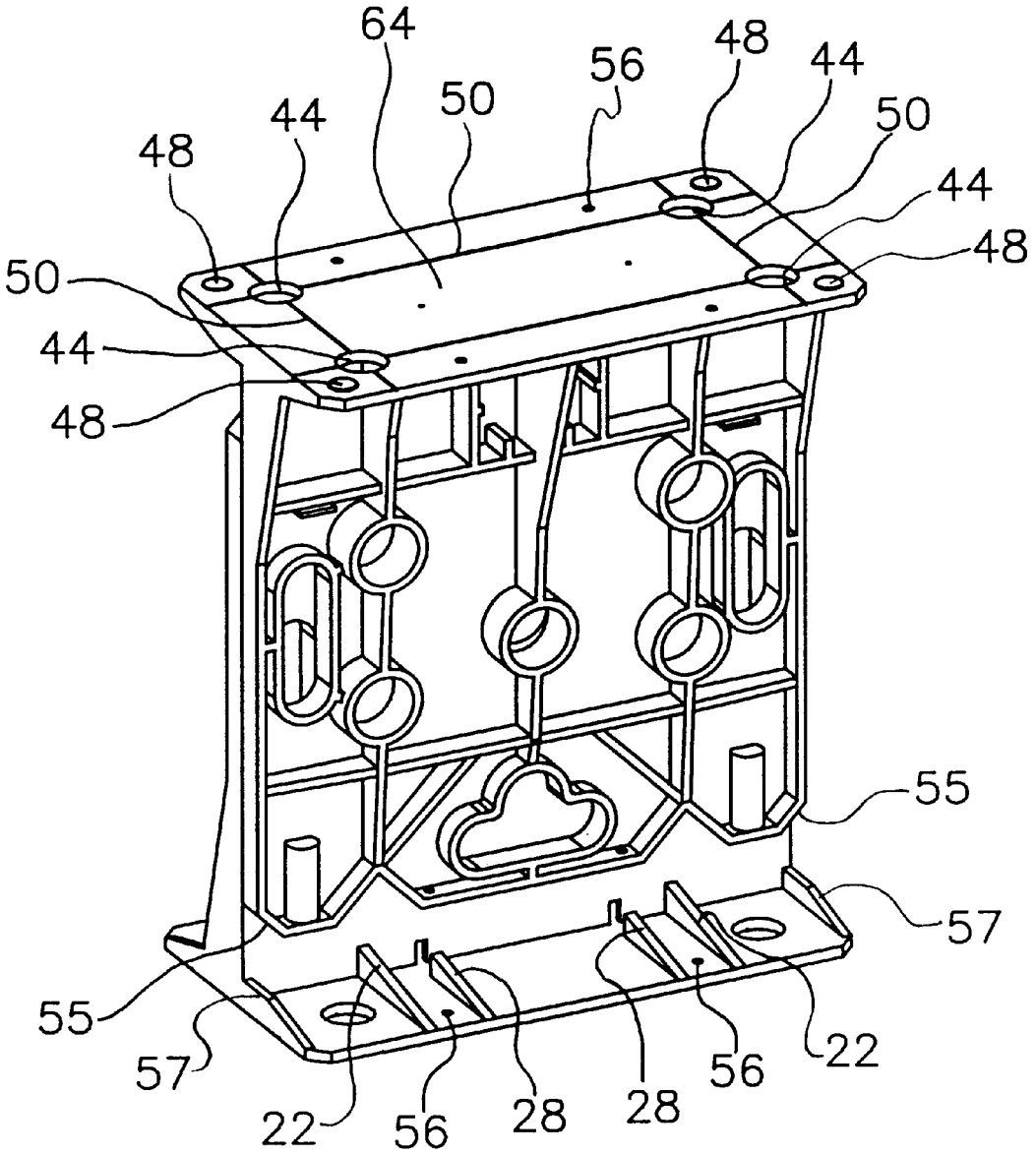
FIG. 6 is an isometric view of two of the stands of FIG. 1 in the process of being coupled together.

As illustrated in FIGS. 4 and 6, the base 12 is provided with four 1⅜" (say) drilling and pipe or conduit carrying holes 44 each adjacent a corner of the base 12. The bottom surface 64 of the base 12 is also provided with four straight alignment lines 50 recessed into the surface 64 such that if the lines 50 extended across the holes 44, the center of each hole 44 would be at the intersection of two of the extended lines 50.

Figure 7:
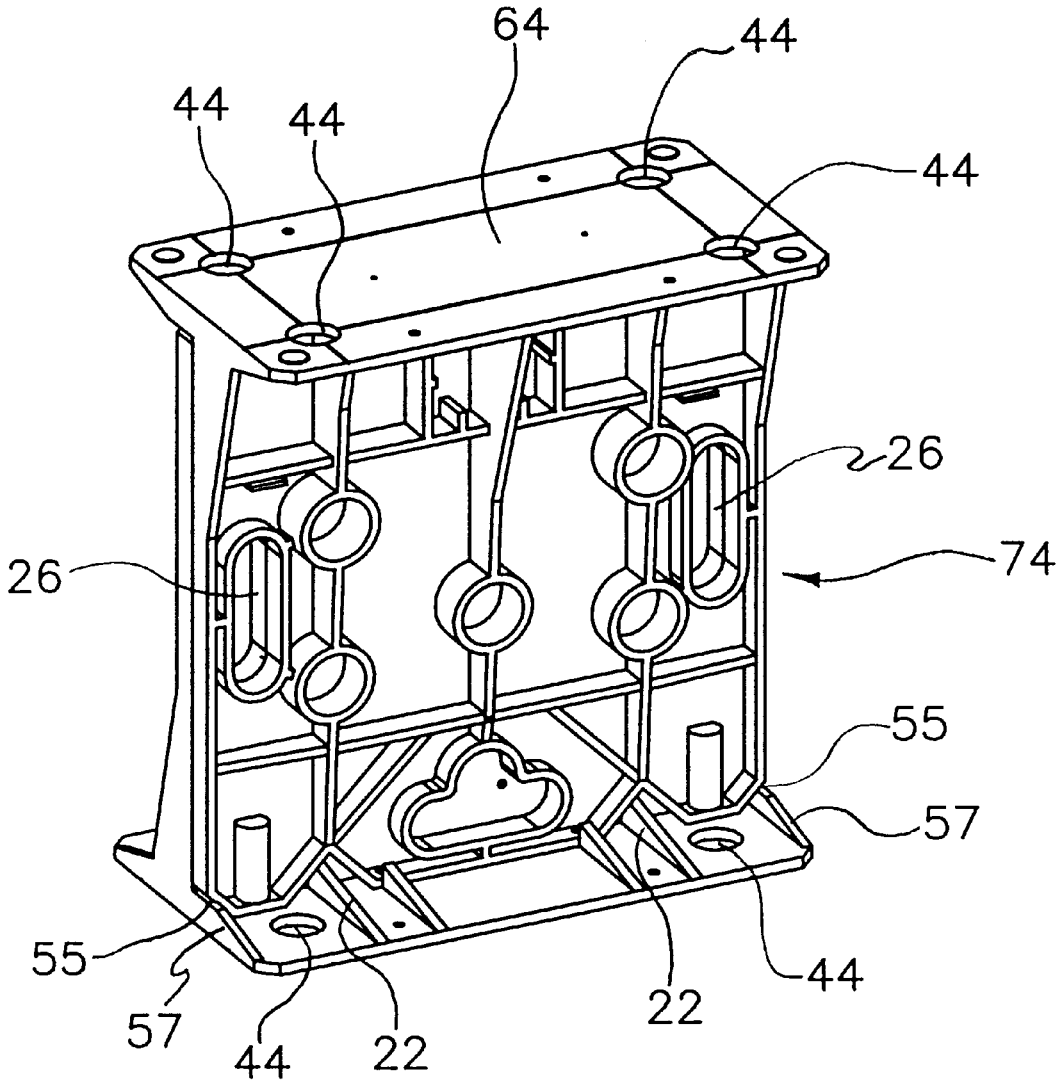
FIG. 7 is an isometric view of two of the stands of FIG. 6 fully coupled together.
Figure 12:
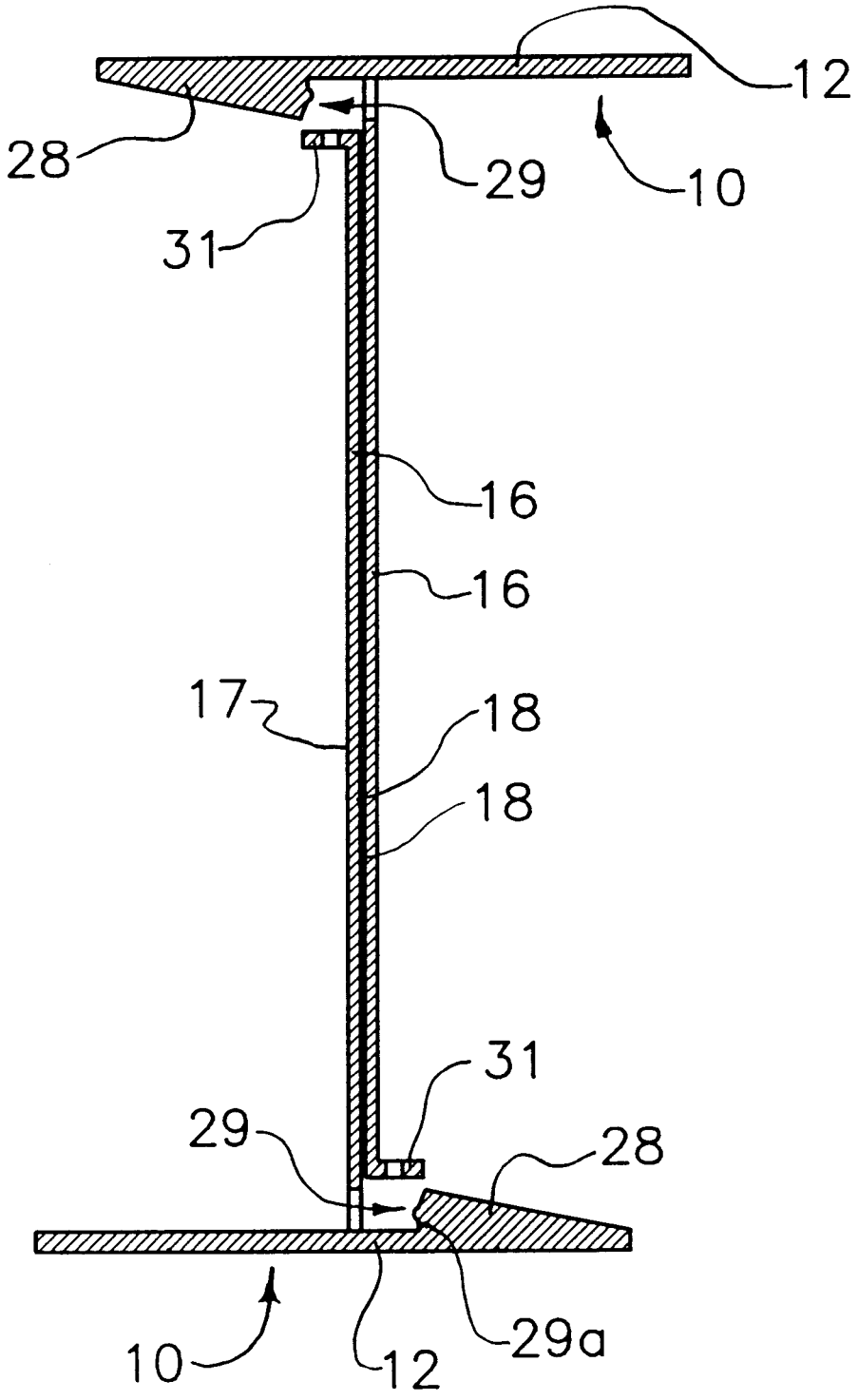
FIG. 12 is a combination of schematic side section views of two of the stands of FIG. 1 in which each section is taken along the line 11—11 in FIG. 3 and in which the stands are in the process of being coupled together as shown in FIG. 6 and 7.

FIGS. 6, 7, and 12 illustrate the manner in which two stands 10 may be snapped together for compact storage and transport as well as for other purposes. FIGS. 6 and 12 show two stands 10 about to be snapped together. The flat back faces 18 of the two stands 10 are placed against each other with one stand upside down. The stands 10 are then slid together so that the top end 31 of each stand 10 snaps into position between the securing ribs 28 and the back face 18 of the other stand 10. The resulting temporarily secured pair of stands 10 is shown in FIG. 7 and is generally indicated by reference numeral 74. It should be noted that the side handle grip openings 26 of the two stands 10 forming the secured pair 74 align with each other so that the secured pair 74 is provided with two convenient handles. The holes 44 in the bases 12 of each of the stands 10 of the secured pair 74 may then be used for carrying pipe or conduit if the pipe or conduit to be carried is passed through corresponding holes 44 in each of the two stands 10 forming the secured pair 74. The secured pair 74 may then be carried using either of the handles 26.

As may be seen from FIG. 7, if two stands 10 are somewhat misaligned as they are slid together, one of the angled sides 55 of the upright 14 of one stand 10 will be forced against a side rib 57 of the other stand 10, tending to push the two stands 10 into alignment. The combination of angled sides 55 and side ribs 57 also tends to restrain the stands 10 from sliding out of alignment when coupled together.

The secured pair 74 may also be used as a stool or a low work table with the bottom surface 64 as a working surface. For example, using the alignment lines 50, a hole may be drilled blind through a workpiece (not shown) using the bottom surface 64 to support the workpiece without danger of drilling into the base 12.

The base 12 is also provided with four base screw holes 56 spaced apart adjacent the long ends of the base 12, two adjacent each long end. Four slightly raised rubber feet 48, each adjacent a corner of the bottom surface 64, are provided to reduce the likelihood of the stand 10 sliding on a smooth surface.

Figure 8:
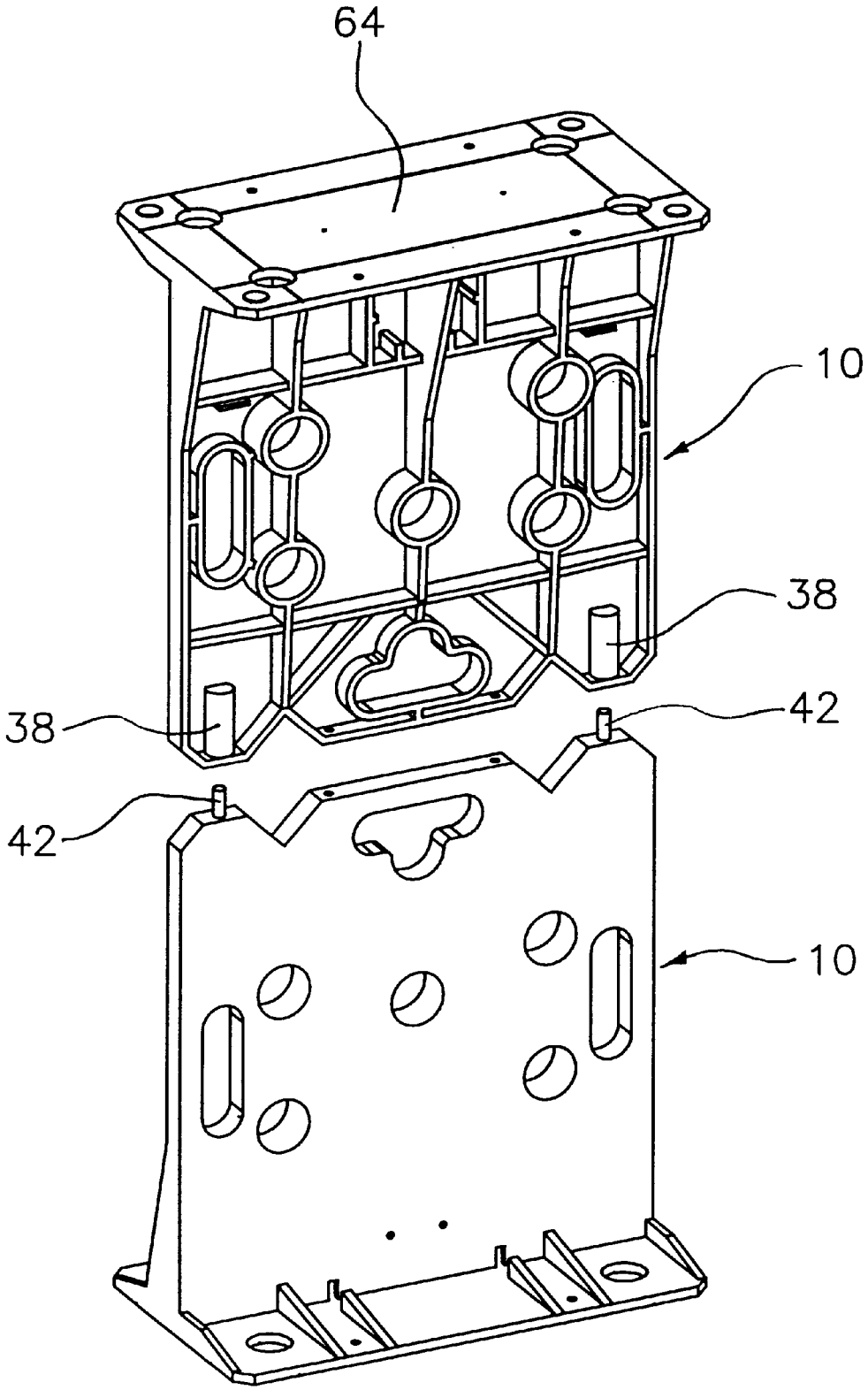
FIG. 8 is an isometric view of two of the stands of FIG. 1 in the process of being coupled together to form a single high table.

As illustrated in FIGS. 4 and 6, protruding from the panel 16 adjacent and parallel to two discrete 3" (say) sections of the strengthening ribs 30 are two coupling pin storage retainers 40. In an exemplary structure, the base of each coupling pin retainer is spaced ⅜" from the adjacent portion of the strengthening rib 30, but is tilted slightly toward the adjacent strengthening rib 30. Two 3" metal coupling pins 42 each ⅜" in diameter are provided with each pair of stands 10 and may be stored between the coupling pin storage retainers 40 and the corresponding adjacent portions of the strengthening rib 30 as shown in FIG. 4. Spaced apart near the extremities of the top end 31 of the stand 10 are two coupling pin sockets 38, each formed with a ⅜" vertical bore approximately 2" deep having an opening 39. Each socket 38 accepts one coupling pin 42 leaving approximately 1" of the coupling pin protruding from 10 the top end 31 of the stand 10 as illustrated in FIG. 8. When not used for coupling pins 42, the sockets 38 can be used for holding appropriately shaped tools such as screwdrivers. (Throughout, the dimensions stated are for an exemplary structure and should not be taken as limiting the scope of the claimed invention.)

As illustrated in FIGS. 8 and 9, a pair of stands 10 may be coupled together using two coupling pins 42 to provide a high work surface 64. As illustrated in FIG. 10, two stands 10 may be coupled with their fronts facing the same direction as well as facing opposite directions as shown in FIGS. 8 and 9. As further illustrated in FIG. 10, two pairs of stands 10, each pair coupled with their fronts facing the same direction, may be connected together using two lengths of 2×4 lumber by inserting each end of each 2×4 length 58 into a 2×4 receiving cavity 46 of a discrete stand 10. The wedge-shaped tabs 51 and 53 allow for slight variation in the cross-sectional area of the 2×4 lengths 58 and help retain the ends of each 2×4 lengths 58 into place. A screw 60 passing through a large washer 62 and screw hole 52 secures the end of each 2×4 length 58 in a receiving cavity 46 of a discrete stand 10. In this manner a framework, generally indicated by reference numeral 72, for a table is formed. A sheet of plywood (not shown) may then be secured to the framework 72 using screws (not shown) passing through base screw holes 56.

Figure 13:
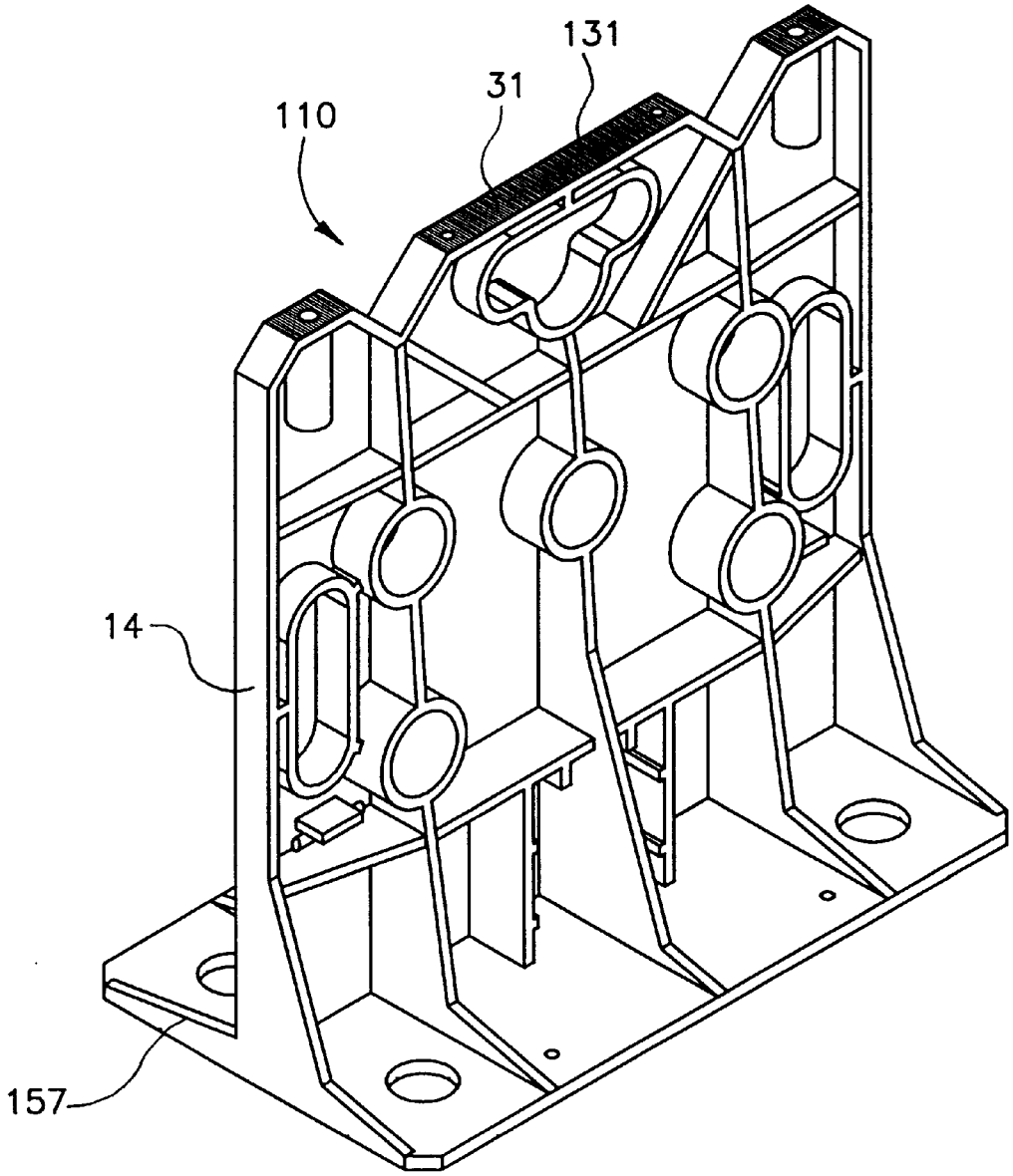
FIG. 13 is an isometric view generally toward the front of a variant of the wire dispenser stand of FIG. 4.
Figure 14:
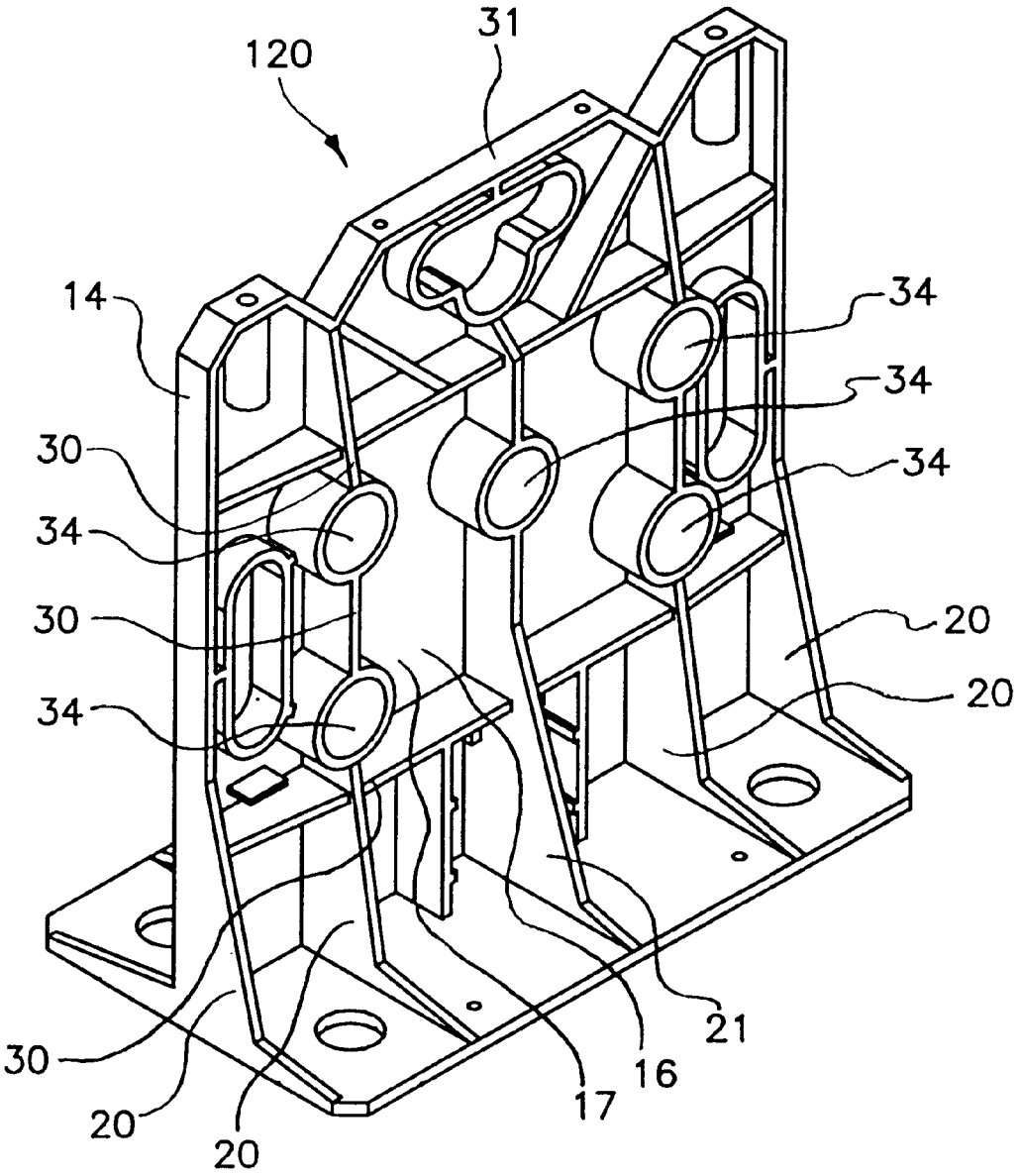
FIG. 14 is an isometric view generally toward the front of another variant of the wire dispenser stand of FIG. 4.

Modifications to the stand 10 shown in FIGS. 1–12 are illustrated in FIGS. 13 and 14.

A modified stand, generally indicated by numeral 110 in FIG. 13, is provided with two modified side ribs 157, one of which is visible in FIG. 13, which slope gently upward toward the upright 14 as compared to the side ribs 57 of stand 10, which have a slope and a horizontal section adjacent to the upright 14. The top end 31 of the modified stand 110 also is provided with a grooved upper surface 131.

In a second modified stand, generally indicated by numeral 120 in FIG. 14, those ribs 30 that form and connect the collars of the collared axle holes 34 all protrude approximately one-and-one-half inches from the front surface 17 of the panel 16 rather than varying from approximately an inch at the top end 31 to approximately one-and-one-half inches where ribs 30 meet the supports 20/21 as provided in stand 10. This modification is expected to add strength and rigidity to the stand 120.

Other modifications will be apparent to those skilled in the art and, therefore, the invention is defined in the claims.

What is claimed is:

1. A wire dispenser stand for use with a mating stand, the mating stand having a base having a generally flat horizontal support surface on the underside thereof and an upright fixed proximally to and extending generally vertically upward from the base, the upright having means for supporting an end of the axle, comprising:

a base having a generally flat horizontal support surface on the underside thereof;

an upright fixed to and extending generally vertically upward from the base, the upright having means for supporting an end of an axle, whereby a wire dispenser may be rotatably mounted on the axle supported by and between the wire dispenser stand and the mating stand, one stand at each end of the axle; and securing means for removably securing the wire dispenser stand in a compact mating interfitting engagement with the mating stand when the mating stand is oriented oppositely to the wire dispensing stand and the stands brought together, the uprights of the stands in said interfitting engagment extending proximately parallel to one another with the distal end of each of the stands engaging the base of the other, thereby coupling the stands together to form a compact structure.

2. The stand as defined in claim 1, wherein the securing means comprises a configured engagement end of the top of the upright and at least one recess in the base located near the bottom of the upright, the recess mating with the configured engagement end of the top of the upright.

3. The stand as defined in claim 2, wherein:

the upright has a generally laterally extending upper engagement end of generally rectangular cross-section, and the base has fixed thereto: at least one securing rib projecting generally vertically upwards from the base and one end of which is generally horizontally spaced from the lower end of the upright so as to form with the opposed generally vertical surface of the upright a recess whose width is selected to match that of the upper engagement end of the upright such that the upper end of the upright of a first such stand may fittingly engage the recess of a second such stand, the upper engagement end of the upright and the recess together constituting the securing means.

4. The stand as defined in claim 3, where the upper end of the upright and the recess are configured to provide a secure engagement.

5. The stand as defined in claim 4, wherein the secure engagement is a snap fit.

6. The stand as defined in claim 5, wherein the surface of the recess is bounded by the upright, the base, and a cross-sectional surface of at least one said securing rib; the cross-section of the securing rib having a flat portion extending vertically upward from the base, followed by a protrusion, said flat portion ending at the top in a ramp portion angled slightly to the vertical in a direction away from the opposed upright whereby the protrusion is axially horizontally spaced from the opposed upright by a distance slightly less than the thickness of the upright and is spaced from the base by a distance just greater than the thickness in a vertical sense of a flange on the top end of the upright so that the configuration provides a snap fit of the upper flanged end of the upright of one stand into the mating recess of an identical such stand, and the protrusion, engaged in a snap fit by the flange of the mating upright, resists vertical displacement (and consequent disengagement) of the upper end of the upright of one interfitting such stand relative to the other such stand.

7. The stand as defined in claim 5, wherein the surface of the recess is bounded by the upright, the base, and a cross-sectional surface of at least one said securing rib; the cross-section of the securing rib being flat, extending vertically upward from the base, and the proximal end of the securing rib being axially horizontally spaced from the opposed upright by a distance slightly less than the thickness of the engagement end of the top of the upright, said engagement end having a flat portion extending vertically downward from the top end of the upright, followed by a small protrusion, said flat portion ending at the bottom part of the engagement end in a ramp portion angled slightly to the vertical in a direction towards the upright, so that the configuration provides a snap fit of the engagement end of the upright of one stand into the mating recess of an identical such stand, and the protrusion, engaged in a snap fit by the flat vertical cross-section of the rib, resists vertical displacement (and consequent disengagement) of the upper end of the upright of one interfitting such stand relative to the other such stand.

8. The stand as defined in claim 5, wherein the surface of the recess is bounded by the upright, the base, and a cross-sectional surface of at least one said securing rib; the cross-section of the securing rib having a flat, portion extending vertically upward from the base, followed by a protrusion, said flat portion ending at the top in a ramp portion angled slightly to the vertical in a direction away from the opposed upright whereby the protrusion is axially horizontally spaced from the opposed upright by a distance slightly less than the combined thickness of the upright and a small protrusion on the engagement end of the top of the upright, said engagement end having a flat portion extending vertically downward from the top, followed by the protrusion, said flat portion ending at the bottom part of the end in a ramp portion angled slightly to the vertical in a direction towards the upright, so that the configuration provides a snap fit of the engagement end of the upright of one stand into the mating recess of an identical such stand, and the engagement in a snap fit of the engagement end with the last-mentioned mating recess resists vertical displacement (and consequent disengagement) of the upper end of the upright of one interfitting such stand relative to the other such stand.

9. The stand as defined in claim 5, wherein the stand is manufactured as a single unit so that the upright and the securing rib are integral with the base.

10. The stand as defined in claim 9, additionally comprising self-aligning means for interfitting which corrects a moderate lateral misplacement of one such stand when being interfitted with a second such stand.

11. The stand as defined in claim 10, where the upright is in the form of a rectangular parallelepiped whose vertical extent and lateral extent are appreciably greater than its thickness; and, similarly, the base is in the form of a parallelepiped whose lateral extent and axially horizontal extent are appreciably greater than its thickness.

12. The stand as defined in claim 11, wherein the vertical surface of the upright facing the securing rib is generally planar and the parallel vertical surface on the other side of the upright is provided with a plurality of raised generally vertically extending strengthening ribs.

13. The stand as defined in claim 12, wherein one side of the recess is formed by at least two of said securing ribs generally laterally spaced from one another.

14. The stand as defined in claim 13, additionally comprising at least one support rib integral with the base and with the vertical side of the upright not facing the securing rib.

15. The stand as defined in claim 14, wherein the self-aligning means comprises:

two support ribs integral with the base and with the vertical side of the upright facing the securing rib and located at opposite ends of the base; and two angled sides at opposite ends of the upper engagement end, whereby, as a first such stand is interfitted with a second such stand, lateral misalignment of the stands is corrected by one of the angled sides of the upper engagement end of each stand being pushed laterally by a corresponding support rib on other stand.

16. The stand as defined in claim 15, wherein the means for supporting an axle comprises at least one hole passing through the upright for receiving an axle.

17. The stand as defined in claim 16, wherein the upright has at least one handle opening disposed so that when two such stands are secured together, a handle opening of one stand aligns with a handle opening of the other stand, whereby a handle is formed for carrying the two stands as a single combined structure.

18. The stand as defined in claim 17, wherein the upper engagement end is provided with at least one V-shaped notch.

19. The stand as defined in claim 18, when secured with a second such stand and supported upon the base of either stand, the inverted base of the non-supporting stand provides an elevated horizontal work surface.

20. The stand as defined in claim 19, wherein the uppermost end of the upright contains at least two spaced generally vertical apertures for holding generally vertically aligned dowels for enabling end-to-end interconnection of two such stands.

21. The stand as defined in claim 20, when at least two apertures are filled with dowels, and a second such stand is inverted so that its upper end is brought into contact with the upper end of the first stand such that the apertures of the second stand align with and surround the dowels in the first stand, a structure is formed by the end-to-end interconnection of the two said stands whereby the base of the second stand, now inverted, provides an elevated horizontal work surface.

22. The stand as defined in claim 21, wherein a combination of strengthening ribs and a portion of the base adjacent to said last mentioned ribs form at least one receiving cavity for holding the end of a beam.

23. The stand as defined in claim 22, additionally comprising at least one hole passing through the upright into the receiving cavity for securing the end of the beam in the receiving cavity with a screw or nail.

24. The stand as defined in claim 23, additionally comprising at least one generally rectangular tab extending into the receiving cavity from the surface of one of the strengthening ribs.

25. A pair of identical stands each constructed according to claim 4.

26. A pair of identical stands each constructed according to claim 9.

* * * * *